United States Patent [19]

Goerlich

[11] Patent Number: 5,044,158

[45] Date of Patent: Sep. 3, 1991

[54] PROCESS AND DEVICE FOR CLOSED-LOOP AND OPEN-LOOP CONTROL OF THE OUTPUT OF A BURNER

[75] Inventor: Dieter Goerlich, Emmering, Fed. Rep. of Germany

[73] Assignee: Webasto Fahrzeugtechnik, Fed. Rep. of Germany

[21] Appl. No.: 390,891

[22] Filed: Aug. 8, 1989

[30] Foreign Application Priority Data

Aug. 12, 1988 [DE] Fed. Rep. of Germany ..... 3827402

[51] Int. Cl.[5] ..... F01N 3/02

[52] U.S. Cl. ..... 60/274; 60/286

[58] Field of Search ..... 60/274, 286

[56] References Cited

U.S. PATENT DOCUMENTS

| | | | |
|---|---|---|---|
| 4,211,075 | 7/1980 | Ludecke | 60/288 |
| 4,424,671 | 1/1984 | Tokura | 60/286 |
| 4,574,589 | 3/1986 | Hasegawa | 60/286 |
| 4,848,086 | 7/1989 | Inoue | 123/564 |

FOREIGN PATENT DOCUMENTS

| | | | |
|---|---|---|---|
| 113232 | 6/1984 | Japan | 60/286 |

*Primary Examiner*—Douglas Hart

*Attorney, Agent, or Firm*—Sixbey, Friedman, Leedom & Ferguson

[57] ABSTRACT

A process and a device for closed-loop and open-loop control of the output of a burner, particularly a burner operated with exhaust gas from an internal combustion engine as an oxygen source for the regeneration of a particle filter unit, in which the burner output is controlled as a function of the average pressure of the internal combustion engine and/or the speed of the engine. Additionally, the temperature between the outlet side of the burner and the particle filter unit can also be entered as a closed-loop variable for closed-loop control. In the device, an open-loop and closed-loop output control device is provided, which receives, as inputs, the temperature, detected by a temperature sensor, and, optionally, the average medium pressure detected by an accelerator sensor, and/or the speed of the internal combustion engine detected by a speed sensor. The temperature sensor is placed downstream from the burner in the exhaust gas section. The output of the open-loop and closed-loop output control device is connected to a fuel quantity control device, by which the amount of fuel or the amount of mixture fed to the burner is controlled.

16 Claims, 1 Drawing Sheet

PROCESS AND DEVICE FOR CLOSED-LOOP AND OPEN-LOOP CONTROL OF THE OUTPUT OF A BURNER

BACKGROUND OF THE INVENTION

The invention relates to a process for closed-loop and open-loop control of the output of a burner, particularly a burner operated with exhaust gas from an internal combustion engine for the regeneration of a particle filter unit, as well as with a device for closed-loop and open-loop control of the output of such a burner.

If for the regeneration of a particle filter unit in the exhaust gas section of an internal combustion engine, particularly a diesel internal combustion engine, a burner is used which delivers the hot combustion gases to initiate the combustion of soot on the soot filter of the particle filter unit to be regenerated, it has turned out that, when operating such a burner with the exhaust gases in the exhaust gas section, widely varying amounts of exhaust gas with various temperatures go through it. For the initiation of the soot combustion on the filter to be regenerated, the burner not only must deliver hot combustion gases which are above a predetermined minimum temperature, but also are below a predetermined maximum temperature to prevent thermally overstressing the structural components connected to the burner, such as the soot filter in particular.

SUMMARY OF THE INVENTION

The primary object of the invention is to, by overcoming the difficulties described above, make available a process and a device for closed-loop and open-loop control of the output of a so-called exhaust gas burner, as a result of which the output of the burner follows quickly and as precisely as possible the load changes of the fuel burning engine, with whose exhaust gases the burner is operated.

According to the invention a process for closed-loop and open-loop control of the output of a burner, particularly of a burner operated with exhaust gas from an internal combustion engine for regenerating a particle filter unit, is distinguished in that the burner output is controlled as a function of the temperature occurring downstream from the burner. In this case, in accordance with a preferred embodiment, the temperature occurring downstream from the burner is continuously monitored and compared to a set point value, to correct the output of the burner to the set point temperature by closed-loop control. In particular, the temperature detected is that which occurs in the area downstream from the burner and before the particle filter to be regenerated, and it is utilized as the closed-loop control variable.

According to a preferred embodiment of the process according to the invention, in addition to the closed-loop control utilizing the temperature downstream from the burner, another open-loop control is superposed to also take into account the average pressure of the internal combustion engine or the engine torque and/or the speed as open-loop control variables for open-loop control and closed-loop control of the burner output, which can be preset as fixed open-loop control variables. As a result of the entire closed-loop control and open-loop control behavior of the process according to the invention, combining closed-loop and open-loop control, response to load changes is achieved quickly and accurately.

In this process, therefore, the burner output is additionally controlled as a function of the average pressure of the internal combustion engine and/or of its speed in a superposed open-loop control circuit. In this kind of a procedure, the respective instantaneous load condition of the internal combustion engine is, therefore, constantly considered by taking into account the average pressure values or the engine torque and/or the speed of the motor for influencing a change in output of the burner, so that the burner output can be corrected with respect to even rapid load changes. As a result, hot combustion gases are produced at the burner outlet in every load condition of the internal combustion engine and during changing load conditions, in which the soot combustion is initiated on the particle filter, but thermal overstressing of the components connected downstream from the burner is prevented.

The determination of the average pressure or the engine torque of an internal combustion engine, whose load condition can change, suitably takes place by way of the accelerator position or the control rod position.

A device for closed-loop and open-loop control of the output of a burner, particularly a burner operated with exhaust gas from an internal combustion engine, for regeneration of a particle filter unit, with a fuel pump and a fuel quantity open-loop control device, in accordance with the invention, is provided with an open-loop and closed-loop output control device, to an input of which the temperature downstream from the burner outlet is applied as a closed-loop control variable and whose output is connected to a fuel quantity control device. This temperature control makes possible a correction of the burner output based upon the temperature occurring downstream from the burner outlet, which serves as a closed-loop control variable.

According to a further advantageous embodiment of the device, an open-loop control can be superposed to achieve a faster response from the temperature control, so that the output open-loop control and closed-loop control device has additional inputs to which the average pressure and/or the speed of the internal combustion engine are applied. In practice, it has been shown that a pure temperature control for changing the output performance of the burner can possibly be too sluggish, but this is particularly a function of the respective operation of the internal combustion engine.

In an advantageous way, the device for closed-loop and open-loop control of the output of a burner according to the invention includes an accelerator sensor, which is connected to the input of the open-loop control and closed-loop output control device. In addition, or as an alternative, a speed sensor can be provided which is connected to a further input of the open-loop and closed-loop output control device. As a speed sensor, a crankshaft sensor is suitably used, or a pulse signal can be detected on the generator and can be evaluated in a corresponding way, since this also makes possible an assignment to the respective speed of the internal combustion engine.

If, in a specific case, no large and rapid speed jumps occur, as for example in the operation of a generator of a diesel internal combustion engine or possibly even in a diesel internal combustion engine installed in a motor vehicle in connection with an automatic transmission, of course, it may be sufficient to take into account only the average pressure of the internal combustion engine in closed-loop and open-loop control of the output of the burner, for example, by the accelerator position and the temperature in the area downstream from the burner outlet. Clearly, the invention also includes further subcombinations of the variables decisive for closed-loop and open-loop control of the output, if corresponding operating conditions occur in the internal combustion engine in a predetermined way.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
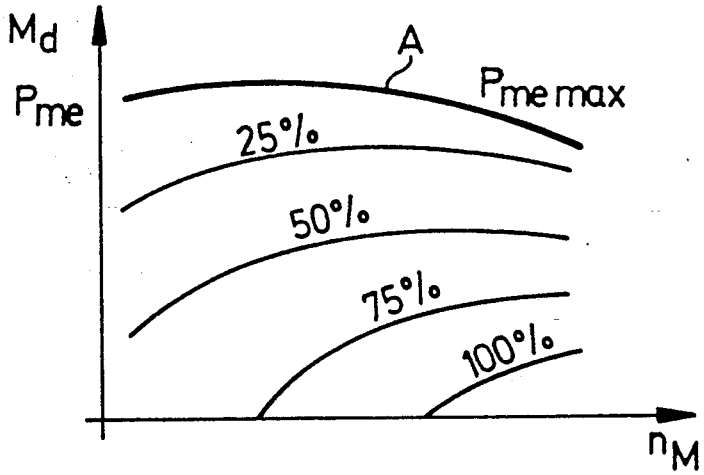
FIG. 1 is a diagram of a family of curves, in which the average pressure value of an internal combustion engine is plotted by the speed, for various burner output percentages.

In the diagram of FIG. 1, the X-axis represents average pressure, $P_{me}$, or engine torque, $M_d$, of an internal combustion engine 3, and the Y-axis represents the speed $n_m$ of the internal combustion engine 3. Curve A, in this diagram according to FIG. 1, corresponds to the course of maximum average pressure values $P_{memax}$. In the area located under the maximum average pressure $P_{memax}$ of the load changes of the internal combustion engine 3, four curves are diagrammatically represented, as an example, to indicate the course of the output to be delivered by the burner for the initiation of the regeneration of a particle filter unit. These curves are assigned to the necessary burner outputs of 25%, 50%, 75% and 100%. Within these output ranges to be provided by the burner, a reliable and quickly responding closed-loop and open-loop control can be performed even in rapidly changing load conditions of the internal combustion engine.

Figure 2:
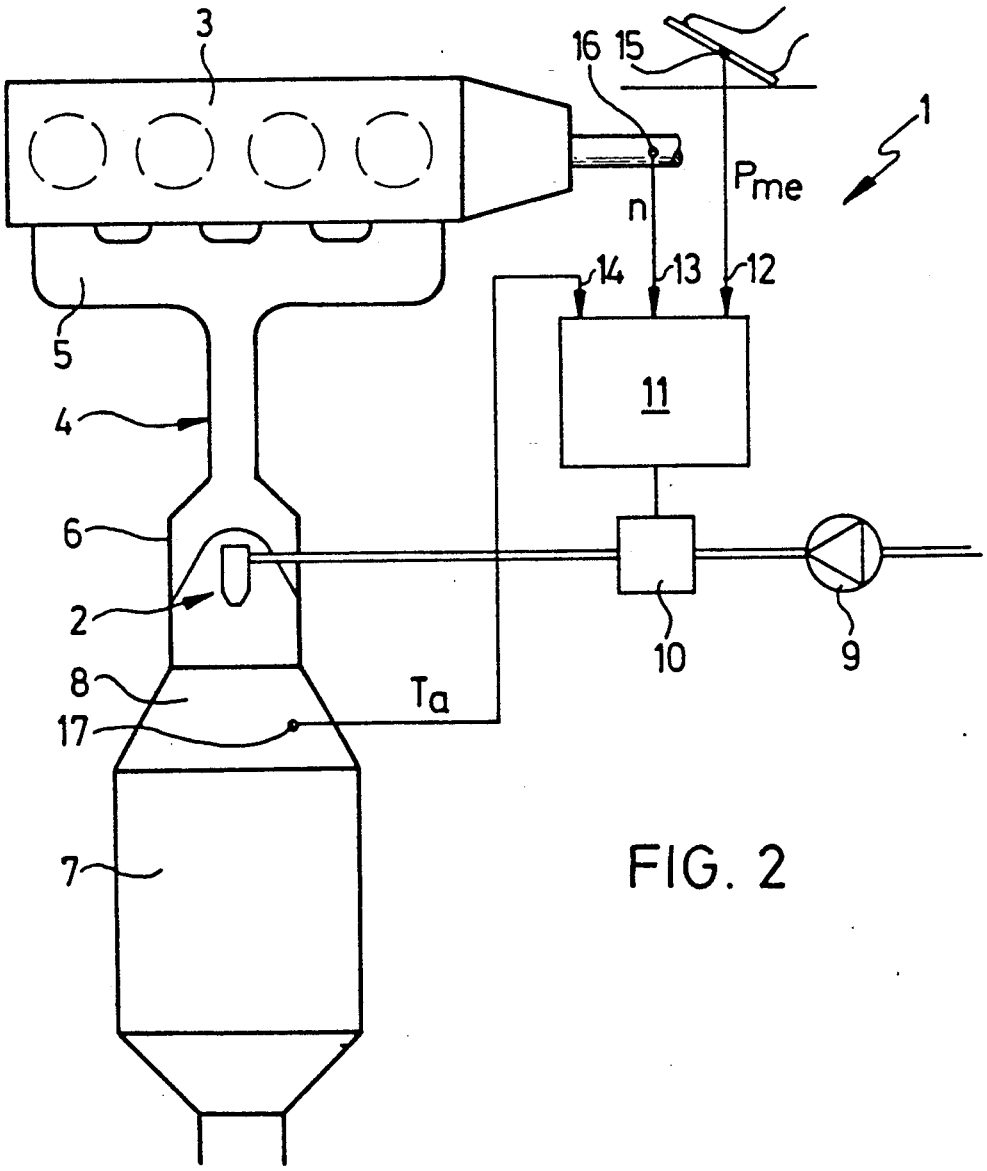
FIG. 2 is a diagrammatic view of a device for closed-loop and open-loop control of the output of a burner, with which the course of the process according to the invention is also explained in greater detail.

In FIG. 2, a device for closed-loop and open-loop control of the output of a burner is shown diagrammatically, which is designated 1, as a whole. The burner 2, in this example, is a so-called exhaust gas burner which is operated with exhaust gases from internal combustion engine 3 as an oxygen source for combustion. The exhaust gas section of the internal combustion engine 3 is designated with 4, as a whole, and comprises a manifold 5, which starts from the outlet side of the cylinders (represented by broken line circles) of internal combustion engine 3, a burner segment 6, in which burner 2 is placed, and a particle filter 7, that is connected to the outlet side of burner segment 6 by an intermediate segment 8. Internal combustion engine 3 is, for example, a diesel internal combustion engine. A fuel or fuel-air mixture supply for burner 2 is provided by a fuel pump 9 under control of a fuel quantity open-loop control device 10. Control device 10 is arranged so that the output produced by burner 2 can be controlled according to preassigned closed-loop control variables and/or open-loop control variables.

According to the invention, an open-loop and closed-loop output control device 11 is provided, whose output is connected to fuel quantity control device 10. Without limiting the invention to this, the open-loop and closed-loop output control device 11 has an input 12, to which average pressure $P_{me}$ is applied, which, while taking into account a constant factor, corresponds to engine torque $M_d$; and input 13, to which speed n of the internal combustion engine 3 is applied, and an input 14, to which a temperature $T_a$, which is present in intermediate segment 8 between the outlet of burner 2 and particle filter 7 is applied. An accelerator sensor 15 is provided for detecting the accelerator position or control rod position, and by which the average pressure $P_{me}$ of internal combustion engine 3 is detected to determine the load condition of internal combustion engine 3. A speed sensor 16, which is formed by a crankshaft sensor, for example, delivers an output signal corresponding to the speed of internal combustion engine 3. A temperature sensor 17 is placed in intermediate segment 8 of exhaust gas section 4.

Device 1 makes it possible to carry out a process for closed-loop and open-loop control of the output of burner 2, in which the burner output is controlled as a function of the average pressure $P_{me}$ of internal combustion engine 3 that is detected by accelerator sensor 15 and/or the speed n of internal combustion engine 3.

In connection with FIG. 1, as a function of these noted variables influencing the control by output open-loop control and closed-loop control device 11, the necessary burner output is controlled by fuel quantity open-loop control device 10, so that it rapidly responds to the respective load changes of the internal combustion engine 3. By taking into account the average pressure $P_{me}$ of internal combustion engine 3 and the engine speed n of the internal combustion engine 3, a rapid approach to the output needed from burner 2 for the soot combustion to be initiated on particle filter 7 is thus obtained. Average pressure $P_{me}$ and/or the speed n of internal combustion engine 3 can be preset as fixed open-loop control variables, for example. With the aid of temperature $T_a$, sensed by temperature sensor 17, a closed-loop control is performed with the aid of open-loop and closed-loop output control device 11 in the device according to the invention. The average pressure $P_{me}$ and the speed n of internal combustion engine 3, in output open-loop and closed-loop control device 11, serve for the rough approximate determination of a set point temperature for the reliable initiation of the soot combustion on particle filter 7, while with the aid of temperature sensor 17 an exact temperature open-loop control can be performed with the aid of output open-loop and closed-loop control device 11.

The process and the device for closed-loop and open-loop control of the output of a burner, in particular of an exhaust gas burner, make it possible for the exhaust gas output of burner 2 to be ale to quickly follow the load changes in internal combustion engine 3 with the least possible delay, so that a temperature of the exhaust gases produced by burner 2 is reached which is sufficiently high for the regeneration of particle filter 7 in every load condition of internal combustion engine 3, but thermal overstressing of the parts of exhaust gas section 4, which follows after burner 2, is effectively prevented.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Process for closed-loop and open-loop control of the output of a burner that is operated, at least in part, with exhaust gas from an internal combustion engine as an oxygen source for the regeneration of a particle filter, comprising continuously gradually closed-loop controlling the burner output during operation of the burner for regeneration of the particle filter as a function of a temperature occurring in an exhaust gas section located downstream from the burner and upstream of the particle filter in accordance with changing load conditions of the internal combustion engine.

2. Process according to claim 1, continuously open-loop controlling the burner output as a function of at least one of an average pressure of the internal combustion engine and the speed of the engine.

3. Process according to claim 2, wherein the average pressure is detected by sensing the position of an accelerator.

4. Device for closed-loop and open-loop control of the output of a burner that is, at least in part, operated with exhaust gas from an internal combustion engine as an oxygen source for the regeneration of a particle filter, comprising a fuel pump and an open-loop fuel quantity control device, wherein an open-loop and closed-loop output control device is provided having an input receiving a signal representative of temperature in an exhaust gas section located downstream from the burner and upstream of the particle filter as a closed-loop variable, and wherein an output of the output control device is connected to the fuel quantity device as a means for continuously gradually controlling the burner output during operation of the burner for regeneration of the particle filter in accordance with changing load conditions of the internal combustion engine.

5. Device according to claim 4, wherein the open-loop and closed-loop output control device has a plurality of additional inputs for receiving open-loop control variables, at least one of average pressure and speed values of the internal combustion engine being applied at a respective one of said additional inputs as a means for enabling the output control device to produce an open-loop control of burner output.

6. Device according to claim 5, wherein an accelerator sensor is connected to one of said additional inputs of the open-loop and closed-loop output control device.

7. Device according to claim 6, wherein a speed sensor is connected to a second one of said additional inputs of the open-loop and closed-loop output control device.

8. Device according to claim 7, wherein said speed sensor is a crankshaft sensor.

9. Device according to claim 7, wherein said speed sensor comprises a means for detecting engine speed as a pulse signal on a generator.

10. Device according to claim 5, wherein a speed sensor is connected to one of said additional inputs of the open-loop and closed-loop output control device.

11. Device according to claim 10, wherein said speed sensor is a crankshaft sensor.

12. Device according to claim 10, wherein said speed sensor comprises a means for detecting engine speed as a pulse signal on a generator.

13. Device according to claim 10, wherein a temperature sensor located in the exhaust gas section downstream from the burner outlet is connected to the temperature signal receiving input of the open-loop and closed-loop control device as a means for enabling closed-loop control of burner output on the basis of signals received therefrom.

14. Device according to claim 6, wherein a temperature sensor located in the exhaust gas section downstream from the burner outlet is connected to the temperature signal receiving input of the open-loop and closed-loop control device as a means for enabling closed-loop control of burner output on the basis of signals received therefrom.

15. Device according to claim 5, wherein a temperature sensor located in the exhaust gas section downstream from the burner outlet is connected to the temperature signal receiving input of the open-loop and closed-loop control device as a means for enabling closed-loop control of burner output on the basis of signals received therefrom.

16. Device according to claim 4, wherein a temperature sensor located in the exhaust gas section downstream from the burner outlet is connected to the temperature signal receiving input of the open-loop and closed-loop control device as a means for enabling closed-loop control of burner output on the basis of signals received therefrom.

* * * * *